US006746275B2

(12) United States Patent
Yamakawa et al.

(10) Patent No.: US 6,746,275 B2
(45) Date of Patent: Jun. 8, 2004

(54) ELECTRIC CONNECTION BOX HAVING A PROTECTING FUNCTION

(75) Inventors: Shuji Yamakawa, Yokkaichi (JP); Eriko Yuasa, Yokkaichi (JP); Hiroki Hirai, Nagoya (JP); Kouji Oota, Nagoya (JP)

(73) Assignees: Autonetworks Technologies, Ltd., Nagoya (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/160,039

(22) Filed: Jun. 4, 2002

(65) Prior Publication Data

US 2002/0182913 A1 Dec. 5, 2002

(30) Foreign Application Priority Data

Jun. 5, 2001 (JP) ..... 2001-169864

(51) Int. Cl.[7] ..... H01R 31/08
(52) U.S. Cl. ..... 439/507; 439/952

(58) Field of Search ..... 439/507, 509, 439/511, 952, 76.2, 621

(56) References Cited

U.S. PATENT DOCUMENTS 5,971,801 A * 10/1999 Kato et al. ..... 439/511
6,366,449 B1 * 4/2002 Hashizawa et al. ..... 361/642

FOREIGN PATENT DOCUMENTS

JP A 10-83753 3/1998
JP A 2000-222999 8/2000

* cited by examiner

*Primary Examiner*—Javaid H. Nasri
(74) *Attorney, Agent, or Firm*—Oliff & Berridge, PLC

(57) ABSTRACT

An electric connection box 111 comprises a stationary unit 11 and a movable member 12. The stationary unit 11 is formed integrally with a box body 113. The movable member 12 is removably attached to the stationary unit 11. When the movable member 12 is detached from the stationary unit 11, the power supply from a battery to an electric load is interrupted.

12 Claims, 17 Drawing Sheets

ELECTRIC CONNECTION BOX HAVING A PROTECTING FUNCTION

BACKGROUND OF THE INVENTION

The present invention relates to an electric connection box having a protecting function to block the power supply from a vehicle-mounted power source to an electric load at the time of maintaining the electric load.

In the prior art, there are mounted on an automobile a number of electric loads such as a radio or a navigation device. Especially in recent years, the electric loads to be mounted has a tendency to increase more and more. In order to cope with the power capacity of the individual electric loads, a battery of 36 B has also been used in addition of the existing battery of 12 V.

For the works to maintain those electric loads, it is not preferable to leave the individual electric loads supplied with the voltage of the battery. Before the maintaining works, therefore, the power supply to each electric load has to be interrupted by detaching the electric wires in advance from the battery.

Therefore, it is proposed that a protecting device for interrupting the power supply from the battery to each electric load at the maintaining time is attached to the vicinity of the battery through an attaching structure such as a connector. The protecting device is proposed, for example, in the Unexamined Japanese Patent Application Publication Nos. 2000-222999 or Hei10-83753. This protecting device is basically arranged in the vicinity of an electric connection box and is electrically connected with the electric connection box through electric wires.

However, the protecting device, as disclosed in the Unexamined Japanese Patent Application Publication Nos. 2000-222999 or Hei10-83753, is mounted in the engine room while being independent of the electric connection box. Therefore, a structure (or electric wires) for connecting the protecting device and the electric connection box with each other is required to raise a problem that the cost for connecting the protecting device and the electric connection box rises. As the more parts are mounted in the engine room for the higher function of the vehicle, moreover, the space for mounting the protecting device may be unable to be retained in the engine room. As a result, another problem is that it is difficult to mount the protecting device in the engine room.

SUMMARY OF THE INVENTION

The present invention is conceived in view of the problems thus far described and has a first object to provide an electric connection box having a protecting function, which can mount a construction corresponding to a protecting device reliably. Moreover, a second object is to provide an electric connection box having a protecting function, which can lower the cost for attaching the construction corresponding to the protecting device.

In order to solve the above-specified objects, according to the invention of Aspect 1, there is provided an electric connection box having a protecting function, comprising a protecting function unit including a stationary unit formed integrally with a box body, and a movable member attached removably to the stationary unit, wherein the supply of an electric power from a vehicle-mounted power source to an electric load is interrupted by removing the movable member from the stationary unit.

In the invention of Aspect 1, according to the invention of Aspect 2, the stationary unit is a mounting recess arranged on the upper side of the box body for housing the movable member.

In the invention of Aspect 2, according to the invention of Aspect 3, that face of the box body, in which the mounting recess is formed, is covered with an upper cover.

In any of the inventions of Aspects 1 to 3, according to the invention of Aspect 4, the movable member is provided with a lever which can be tilted in an opposite direction away from the side of an electric part mounting portion capable of mounting an electric part.

Here will be described the "actions" of the present invention.

According to the invention of Aspect 1, the stationary unit constructing the protecting function unit together with the movable member is formed integrally with the box body so that the attaching structure for fixing the protecting function unit need not be manufactured separately of the electric connection box. Therefore, it is possible to lower the cost necessary for mounting the construction corresponding to the protecting device in the electric connection box. According to the invention having the electric connection box provided with the protecting function unit, moreover, the protecting function can be given to the electric connection box even if the space for mounting the protecting device in the engine room cannot be retained. Moreover, the stationary unit is integral with the box body so that the construction for connecting the stationary unit and the box body electrically need not be provided. Thus, it is possible to improve the reliability of the electric connection box.

According to the invention of Aspect 2, the stationary unit is arranged on the upper side of the box body so that the movable member is exposed to an easily visible position at the working time for maintenances. Therefore, it is possible to improve the controllability of the movable member.

On the other hand, the movable member is mounted in the mounting recess so that the portion of the movable member projecting from the box body is reduced. Therefore, it is possible to reduce the size of the electric connection box. At this time, the movable member is held not only at its bottom face but also its side faces by the mounting recess. Therefore, it is possible to improve the attaching strength of the movable member. Moreover, the external force hardly acts directly on the movable member thereby to prevent the movable member from being detached by the external force. Therefore, the electric connection between the movable member and the electric connection box can be reliably kept to stabilize the power supply from the vehicle-mounted power source to the electric load. Moreover, the exposed position of the movable member can be reduced to improve the water-proofness of the movable member.

According to the invention of Aspect 3, the movable member and the stationary unit are covered with the upper cover so that the construction having the protecting function can be housed in the electric connection box. Therefore, it is possible to protect the protecting function unit reliably against water.

According to the invention of Aspect 4, the movable member is provided with the lever so that it can be easily attached/detached. Moreover, the lever is tilted in the opposite direction away from the side of the electric part mounting portion so that it can be prevented from obstructing the maintaining works of the electric parts. When the lever is gripped, moreover, the hands of the worker can be prevented from touching the electric parts or the like.

DETAILED DESCRIPTION OF THE PREFERRED EMBODIMENTS

With reference to FIGS. 1 to 17, here will be detailed one embodiment of an electric connection box having a protecting function for an automobile according to the invention.

Figure 1:
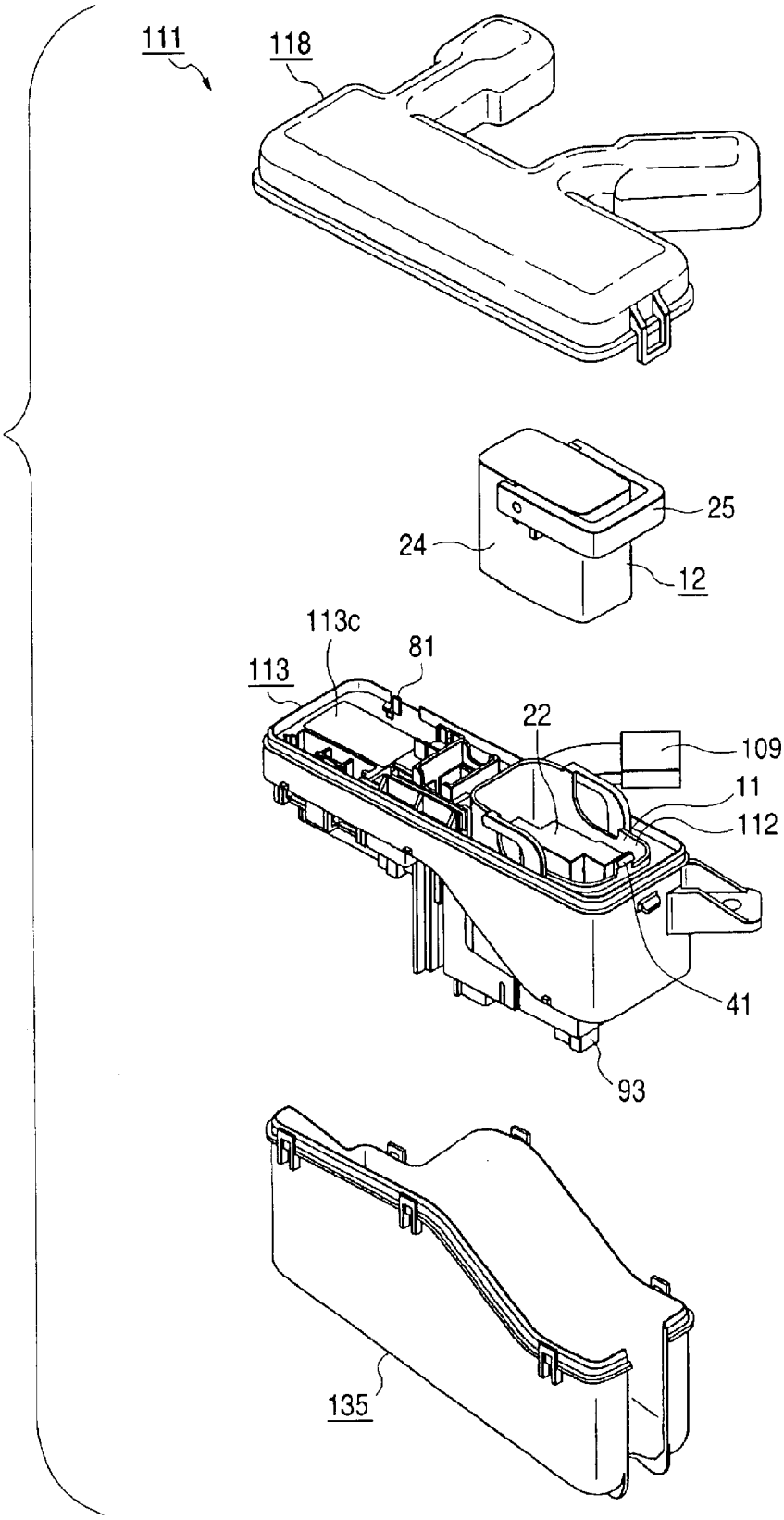
FIG. 1 is an exploded perspective view showing an electric connection box of the embodiment.
Figure 2:
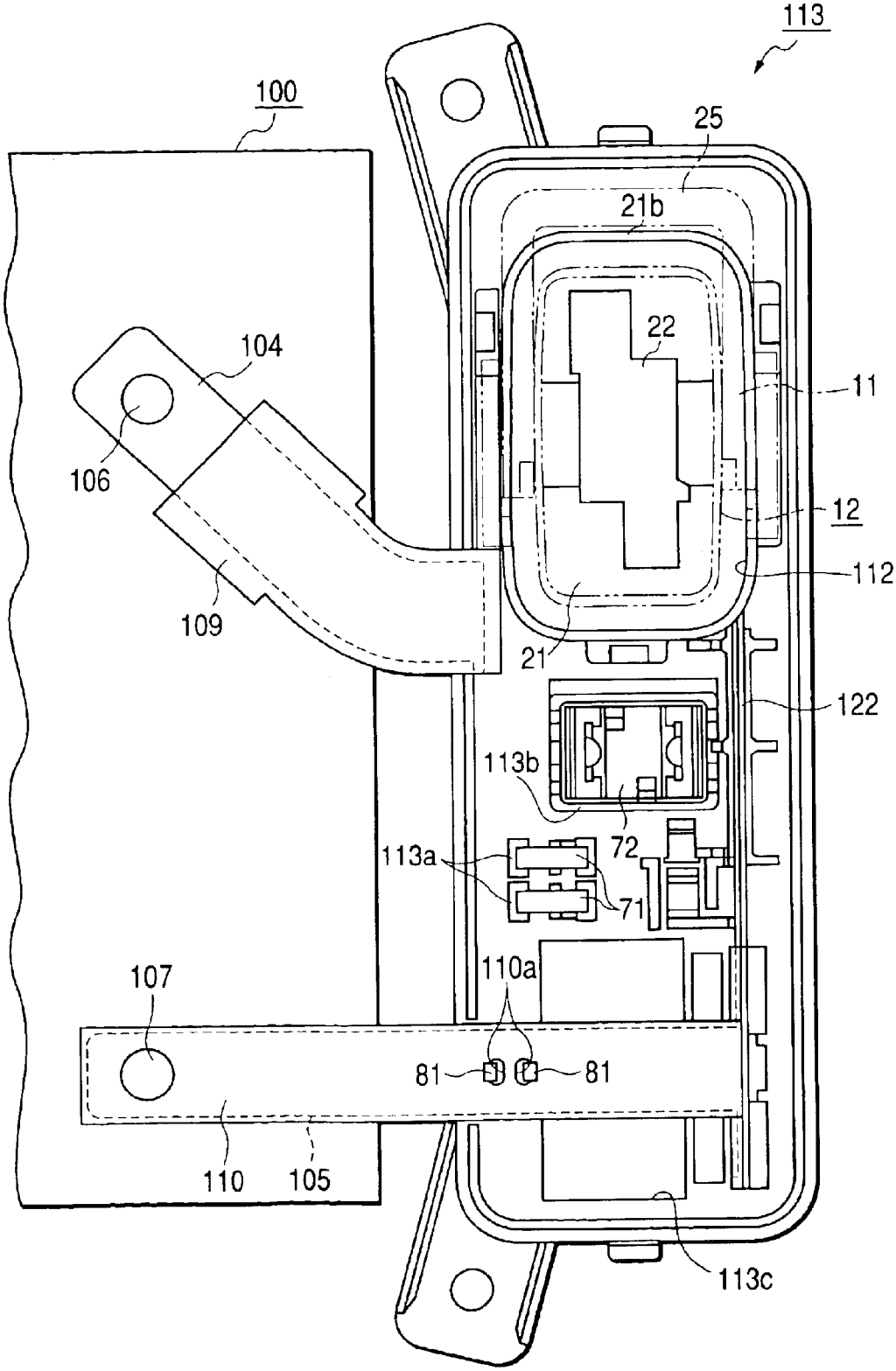
FIG. 2 is a top plan view of a box body.

As shown in FIG. 1, an electric connection box 111 is constructed by attaching an upper cover 118 and a lower cover 135 to a box body 113. As shown in FIG. 2, the electric connection box 111 is attached directly to a battery 100 or a car-mounted power source through battery connecting plates 104 and 105. Specifically, the leading end portion of the battery connecting plate 104 is attached to the positive terminal 106 of the battery 100. The battery connecting plate 104 is covered with a protecting portion 109. On the other hand, the leading end portion of the battery connecting plate 105 is attached to the negative terminal 107 of the battery 100. The battery connecting plate 105 is covered with a protecting portion 110. Here, these protecting portions 109 and 110, the positive terminal 106 and the negative terminal 107 are covered with the upper cover 118.

As shown in FIG. 2, the box body 113 is provided on its upper face with a pair of fitting projections 81. These fitting projections 81 fix the protecting portion 110 and the battery connecting plate 105 on the box body 113 when they engage with engaging holes 110*a* formed in the protecting portion 110.

On the upper face of the box body 113, there are further provided fuse mounting portions 113*a* and 113*b* and a current sensor mounting portion 113*c* as the electric part mounting portions. In the fuse mounting portions 113*a* and 113*b*, there are mounted fuses 71 and 72 as the electric parts. On the current sensor mounting portion 113*c*, there is mounted a not-shown current sensor as the electric part.

Figure 4:
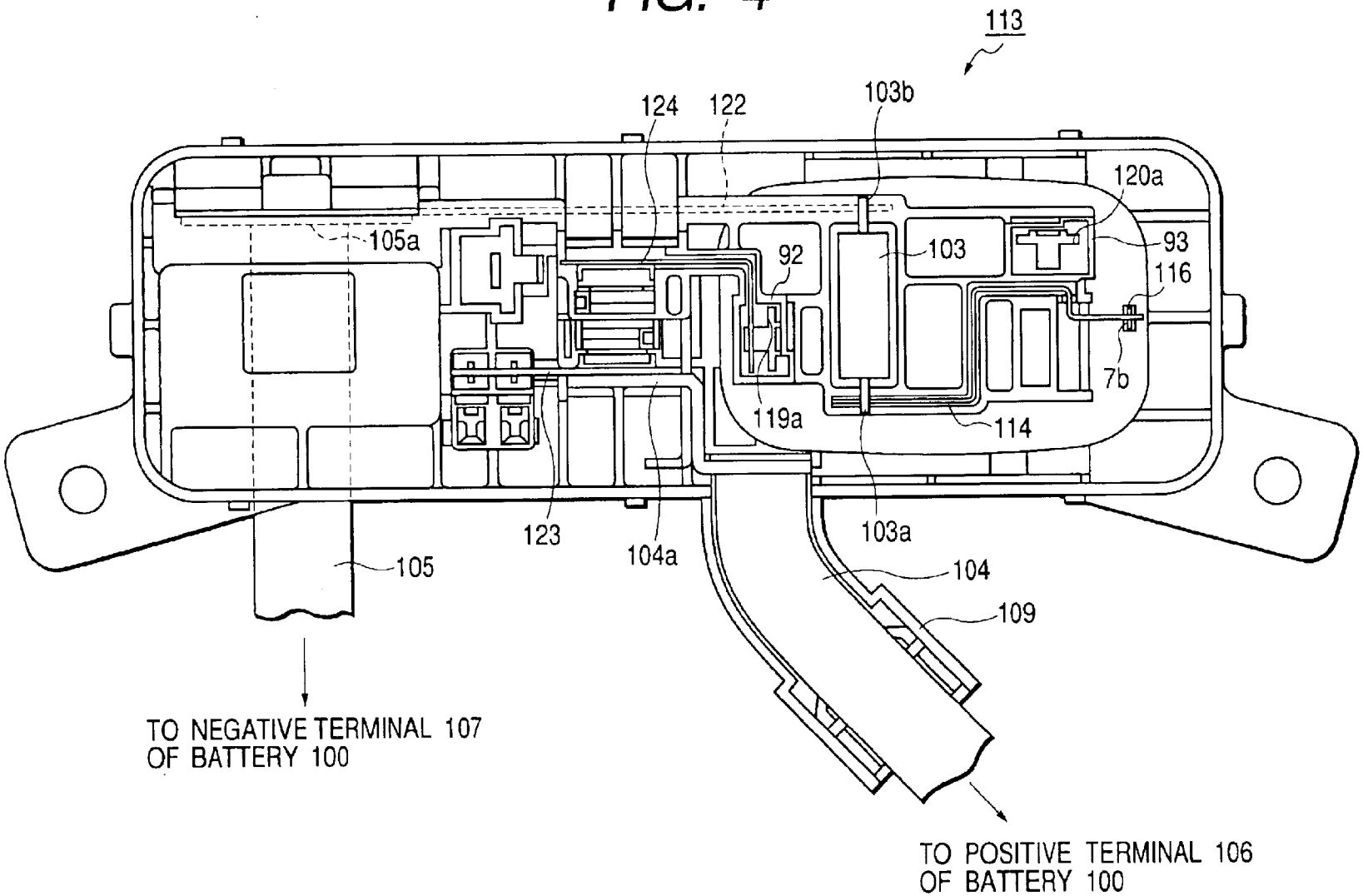
FIG. 4 is a bottom view of the box body.

As shown in FIG. 4, the box body 113 is provided on its bottom face with a mounting portion 92. On the bottom face of the box body 113, there is further provided a connector mounting portion 93. On this connector mounting portion 93, there is mounted a not-shown connector. This connector connects a later-described electric load 101 electrically. On the bottom face of the box body 113, there is further provided a discharge resistor 103.

To the box body 113, as shown in FIG. 4, there is attached a conductor plate 123 from the side of the bottom face of the box body 113. This conductor plate 123 is made of a metal sheet having an electric conductivity. The conductor plate 123 makes contact with the root end portion 104*a* of the battery connecting plate 104. On the other hand, the conductor plate 123 is electrically contacted by the terminal portion of the fuse 71. Moreover, the conductor plate 123 is electrically connected with the terminal portion of the fuse 72.

To the box body 113, as shown in FIG. 4, there is attached a conductor plate 124 from the side of the bottom face of the box body 113. This conductor plate 124 is formed by bending an electrically conductive metal sheet generally into an L-shape. One end of the conductor plate 124 is electrically connected with the terminal portion of the fuse 72. On the other hand, the other end of the conductor plate 124 is housed in the mounting portion 92.

Figure 3:
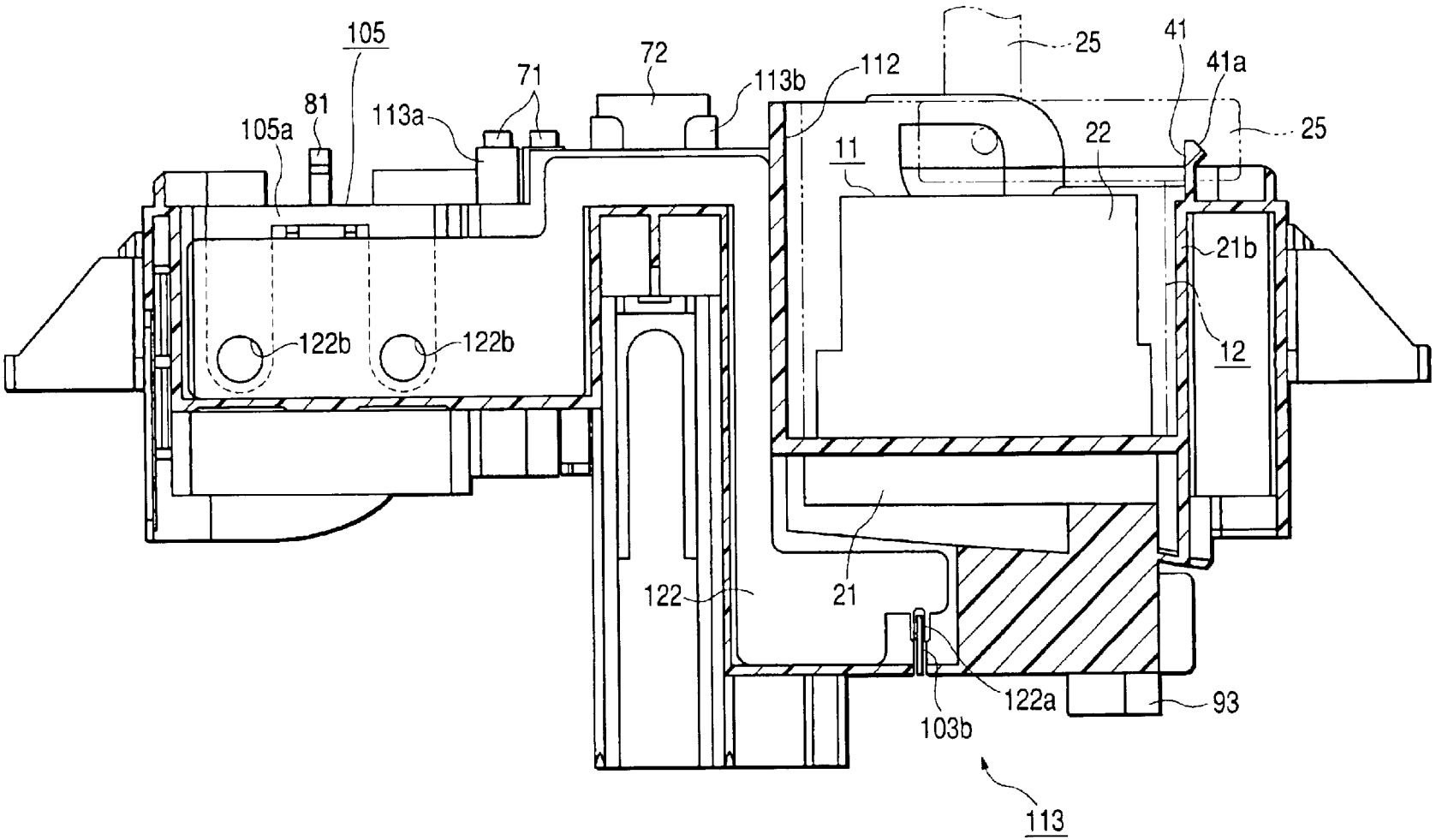
FIG. 3 is a sectional side elevation of the box body.

To the box body 113, as shown in FIG. 3, there is attached a conductor plate 122 from the side of the upper face of the box body 113. This conductor plate 122 is formed of a metal sheet having an electric conductivity. The conductor plate 122 is notched generally in a U-shape at its one end to form a forced contact portion 122*a*. As shown in FIG. 4, too, one end 103*b* of the discharge resistor 103 is electrically connected with the forced contact portion 122*a*. At the other end of the conductor plate 122, on the other hand, there are formed two bolt inserting holes 122*b*. By inserting the not-shown bolts into these individual bolt inserting holes 122*b*, the conductor plate 122 is connected with the root end portion 105*a* of the battery connecting plate 105. As a result, the discharge resistor 103 and the battery 100 are electrically connected.

To the box body 113, as shown in FIG. 4, there is attached a conductor plate 114 as a conductor member from the side of the bottom face of the box body 113. This conductor plate 114 is formed by bending a metal sheet having an electric conductivity. With one end of the conductor plate 114, there is electrically connected on end 103*a* of the discharge resistor 103. As a result, the conductor plate 114 and the battery 100 are electrically connected.

As shown in FIGS. 1 to 3, on the other hand, a stationary unit 11 is formed integrally with the box body 113. The stationary unit 11 is arranged on the upper side of the box body 113. This stationary unit 11 is provided with a mounting recess 112. This mounting recess 112 is opened in that face of the box body 113, which is provided with the fuse mounting portions 113*a* and 113*b* and the current sensor mounting portion 113*c*. The opening of the mounting recess 112 has a generally rectangular shape. That face of the box body 113, which is provided with the mounting recess 112, is covered with the upper cover 118. To this mounting recess 112, there is removably attached a movable member 12.

As shown in FIG. 4, the box body 113 is provided in its bottom face with an input terminal inserting hole 119*a* having a generally rectangular shape. In the bottom face of the box body 113, there is also formed an output terminal inserting hole 120*a* having a generally rectangular shape. In the bottom face of the box body 113, there is further formed a bus bar inserting hole 116 having a generally rectangular shape.

Here will be described the circuit construction of the protecting function.

Figure 5:
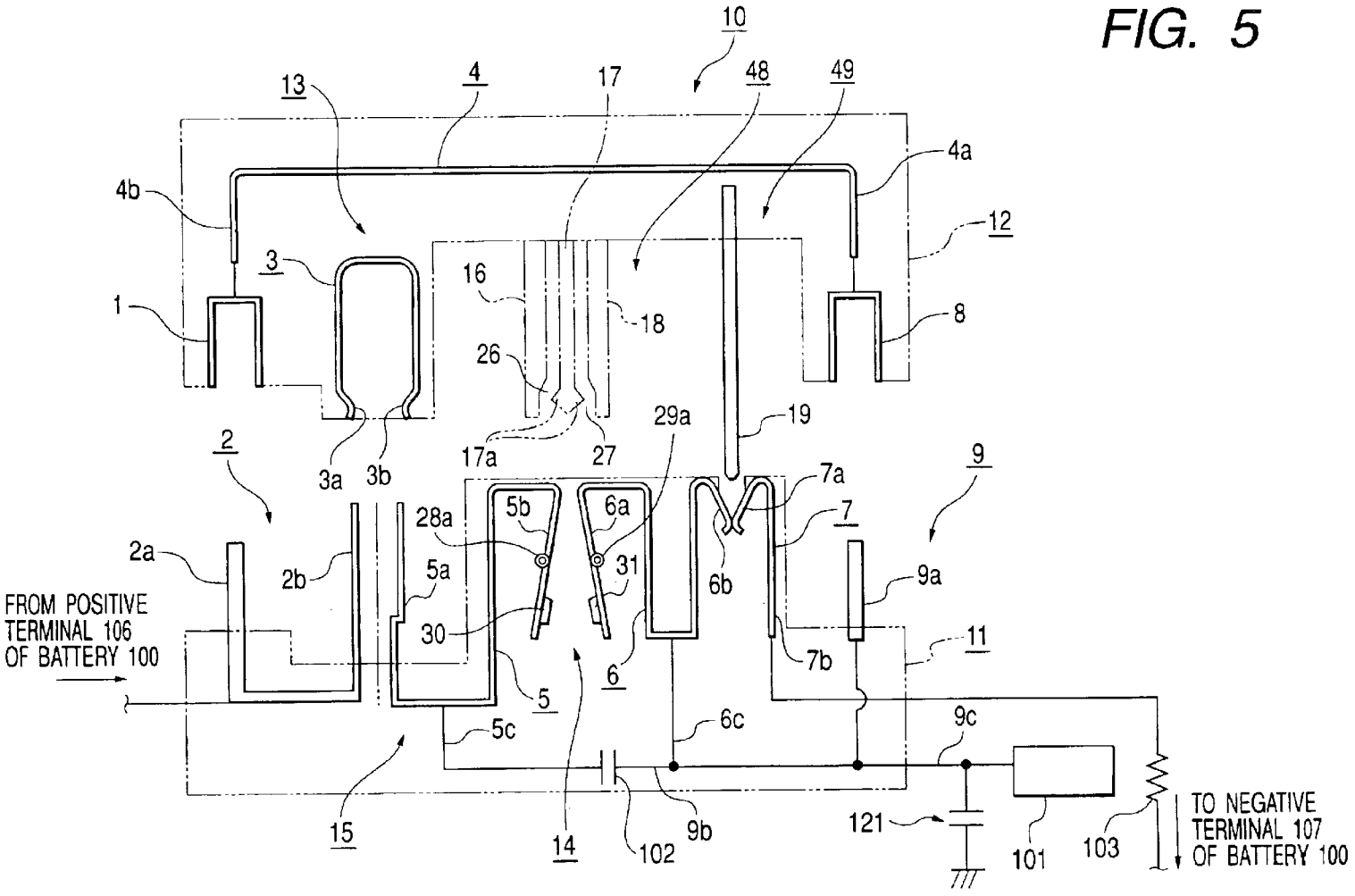
FIG. 5 is a circuit diagram showing the detached state of a movable member.
Figure 6:
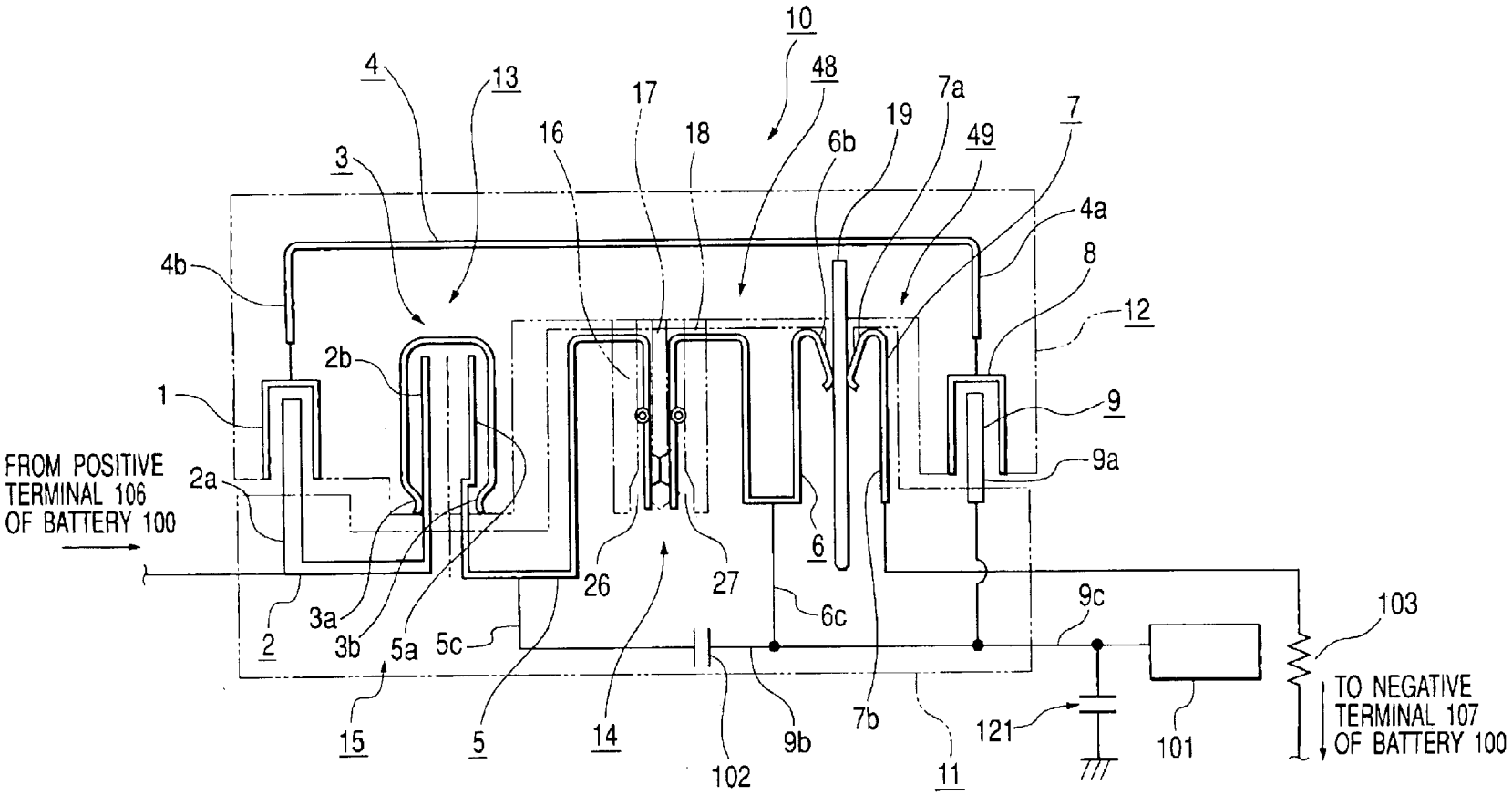
FIG. 6 is a circuit diagram showing the attached state of the movable member.

As shown in FIGS. 5 and 6, the stationary unit 11 and the movable member 12 constructing the protecting function unit are interposed between the battery 100 and the electric load 101 such as a radio or a navigation device so that they interrupt, if necessary, the power supply from the battery 100 to the electric load 101. In this embodiment, the battery 100 takes a voltage of 36 V at a discharge time. Here, the electric load 101 may be mounted by one or a plurality in the vehicle.

Moreover, the stationary unit 11 is provided with an input terminal 2, an output terminal 9 and terminal members 5 and 6. The input terminal 2 is connected with the battery 100. The output terminal 9 and the terminal member 6 are connected directly with the electric load 101. The terminal member 5 is connected through a capacitor 102. Here, the terminal members 5 and 6 function as a portion of a second current path 15 for connecting the input terminal 2 and the output terminal 9.

On the other hand, the movable member 12 is provided with moving side connecting terminals 1 and 8 constructing a first current path. The moving side connecting terminal 1 is connected with a terminal portion 2*a* of the input terminal 2 when the movable member 12 is attached to the stationary unit 11 (as will be called the "attached state") On the other hand, the moving side connecting terminal 8 is connected in the attached state with the terminal portion 9*a* of the output terminal 9. Moreover, the movable member 12 is provided with a conductor member 4 and a connecting conductor 3, which construct the first current path. The conductor member 4 connects the moving side connecting terminal 1 and the moving side connecting terminal 8 with each other.

When the movable member 12 is detached from the stationary unit 11 (as will be called the "detached state"), as shown in FIG. 5, the moving side connecting terminal 1 and the input terminal 2 leave each other. Simultaneously with this, the moving side connecting terminal 8 and the output terminal 9 leave each other. In the attached state, as shown in FIG. 6, the voltage from the battery 100 is applied to the electric load 101 through the input terminal 2, the moving side connecting terminals 1 and 8, the conductor member 4 and the output terminal 9.

Moreover, a power switching terminal portion 2*b* of the input terminal 2 is arranged to confront a power switching terminal portion 5*a* of the terminal member 5. When the movable member 12 is to be attached to the stationary unit 11, at first, the terminal portion 3*a* of the connecting conductor 3 is connected with the power switching terminal portion 2*b*, and the terminal portion 3*b* of the connecting conductor 3 is connected with the power switching terminal portion 5*a*. When the movable member 12 is completely attached to the stationary unit 11, moreover, the terminal portion 3*b* and the power switching terminal portion 5*a* are separated from each other. Here, the terminal portion 3*a* keeps the state in which it is connected with the power switching terminal portion 2*b*. Moreover, the power switching terminal portions 2*b* and 5*a* are disconnected in the detached state from the terminal portions 3*a* and 3*b* of the connecting conductor 3. In short, the power switching terminal portions 2*b* and 5*a* and the connecting conductor 3 function as power switching means 13 for switching the second current path 15 into the ON state and the OFF state.

On the other hand, the terminal members 5 and 6 are formed of an elastically deformable material such as phosphor bronze. Spring members 5*b* and 6*a* are set to leave each other in a natural state. These two spring members 5*b* and 6*a* make contact in the attached state and leave each other in the detached state. In short, the spring members 5*b* and 6*a* function as first contact means 14. This first contact means is turned ON/OFF by guide grooves 26 and 27 between three depending members 16, 17 and 18. The individual guide grooves 26 and 27 are arranged in parallel with each other. The individual depending members 16 to 18 are disposed in the movable member 12. A thick portion 17*a* is bulged to the two side portions from the lower end portion of the central depending member 17. Here, the depending members 16 to 18 function as a control unit 48. These depending members 16 to 18 are caused to bring terminal protecting contacts 30 and 31 into abutment against each other by closing the spring members 5*b* and 6*a* forcedly when the movable member 12 is to be mounted.

When the movable member 12 is to be attached, more specifically, a turning portion 28*a* is guided in the guide groove 26, and a turning portion 29*a* is guided in the guide groove 27. When the thick portion 17*a* passes between the turning portions 28*a* and 29*a*, moreover, these turning portions 28*a* and 29*a* are guided by the parallel portions of the guide grooves 26 and 27. As a result, the spring members 5*b* and 6*a* separated come closer to each other so that the two terminal protecting contacts 30 and 31 come into abutment against each other. When the movable member 12 is to be detached, on the other hand, the actions are reversed from the aforementioned ones, and the spring members 5*b* and 6*a* restore their separated states so that the two terminal protecting contacts 30 and 31 go out of abutment.

Here, the two terminal protecting contacts 30 and 31 are formed of a material having a higher arc-resistance than the conductive material (e.g., copper) which is generally used in the input terminal 2 and the output terminal 9. The terminal protecting contacts 30 and 31 are formed of a material of Ag—CdO, a material of Ag—Ni, a material of Ag—a metal oxide or a material of Ag—Gr, for example.

Moreover, the terminal portion of the terminal member 6 is connected with the electric load 101 and a capacitor 121. This capacitor 121 is grounded to the earth. The battery 100 and the electric load 101 are connected with each other through the power switching means 13 and the first contact means 14 in the second current path 15.

On the other hand, a terminal portion 6*b* is switched to the connected or disconnected state with respect to a terminal portion 7*a*. These terminal portions 6*b* and 7*a* constructed second contact means 49. This second contact means 49 is so set that the terminal portions 6*b* and 7*a* are connected in the natural state with each other. Moreover, the terminal portions 6*b* and 7*a* are so set that they are disconnected in the attached state by a depending member 19. Here, the tab portion 7*b* of the bus bar 7 is connected with the discharge resistor 103. This discharge resistor 103 is electrically connected with the negative terminal 107 of the battery 100.

Here will be described the mechanical constructions of the stationary unit 11 and the movable member 12.

Figure 8:
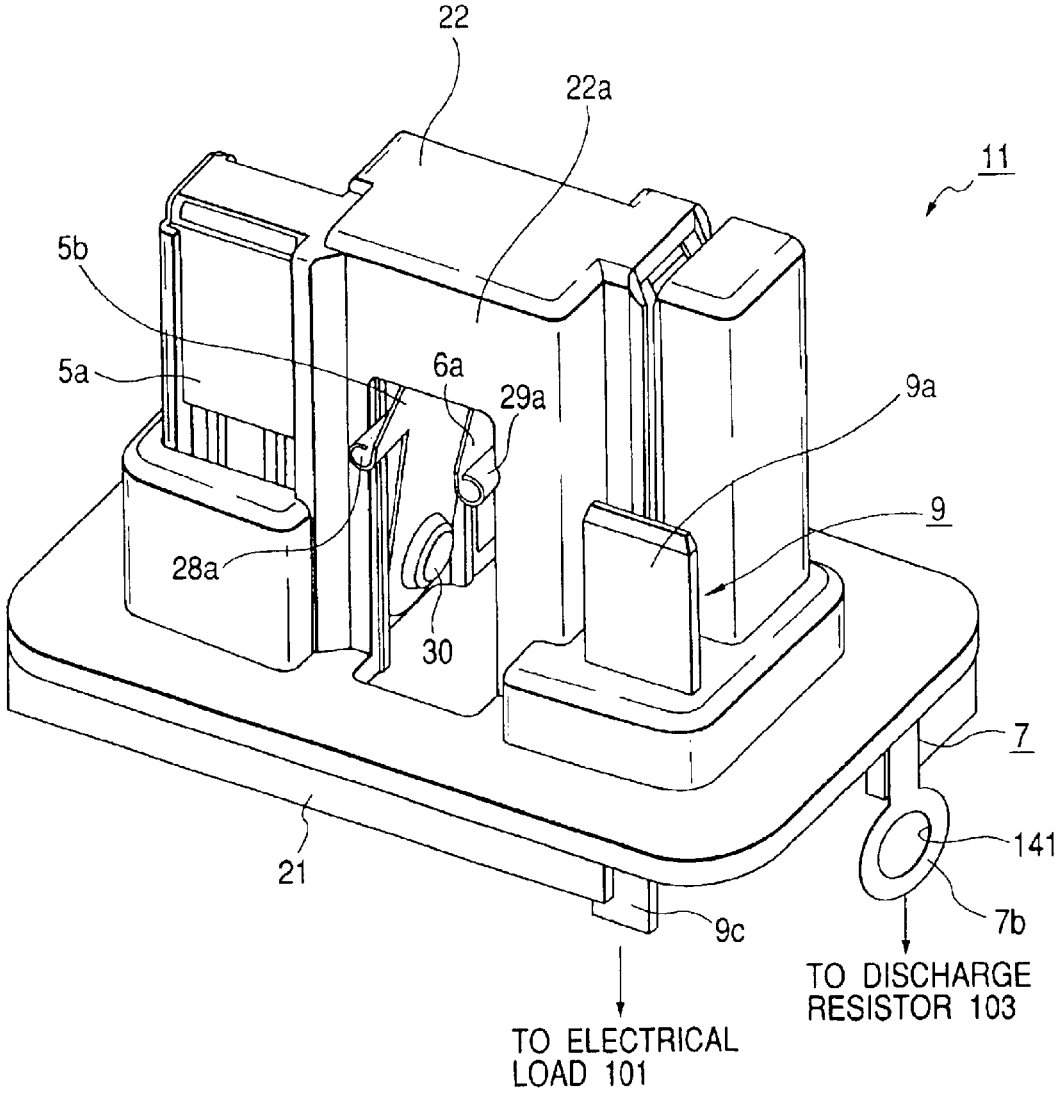
FIG. 8 is a perspective view of an essential portion of the stationary unit.

As shown in FIG. 8, the stationary unit 11 is constructed by covering a housing 21 partially with a housing cover 22. The housing 21 and the housing cover 22 are formed of an insulating material such as a synthetic resin.

As shown in FIGS. 1 and 3, the upper end portion of the housing 21 is projected from the upper face of the box body 113. The housing 21 is provided with a retaining portion 41 at its upper end portion. This retaining portion 41 is arranged on a wall portion 21*b* of the housing 21. The retaining portion 41 has a hook portion 41*a* projected to the outside of the housing 21.

Figure 7:
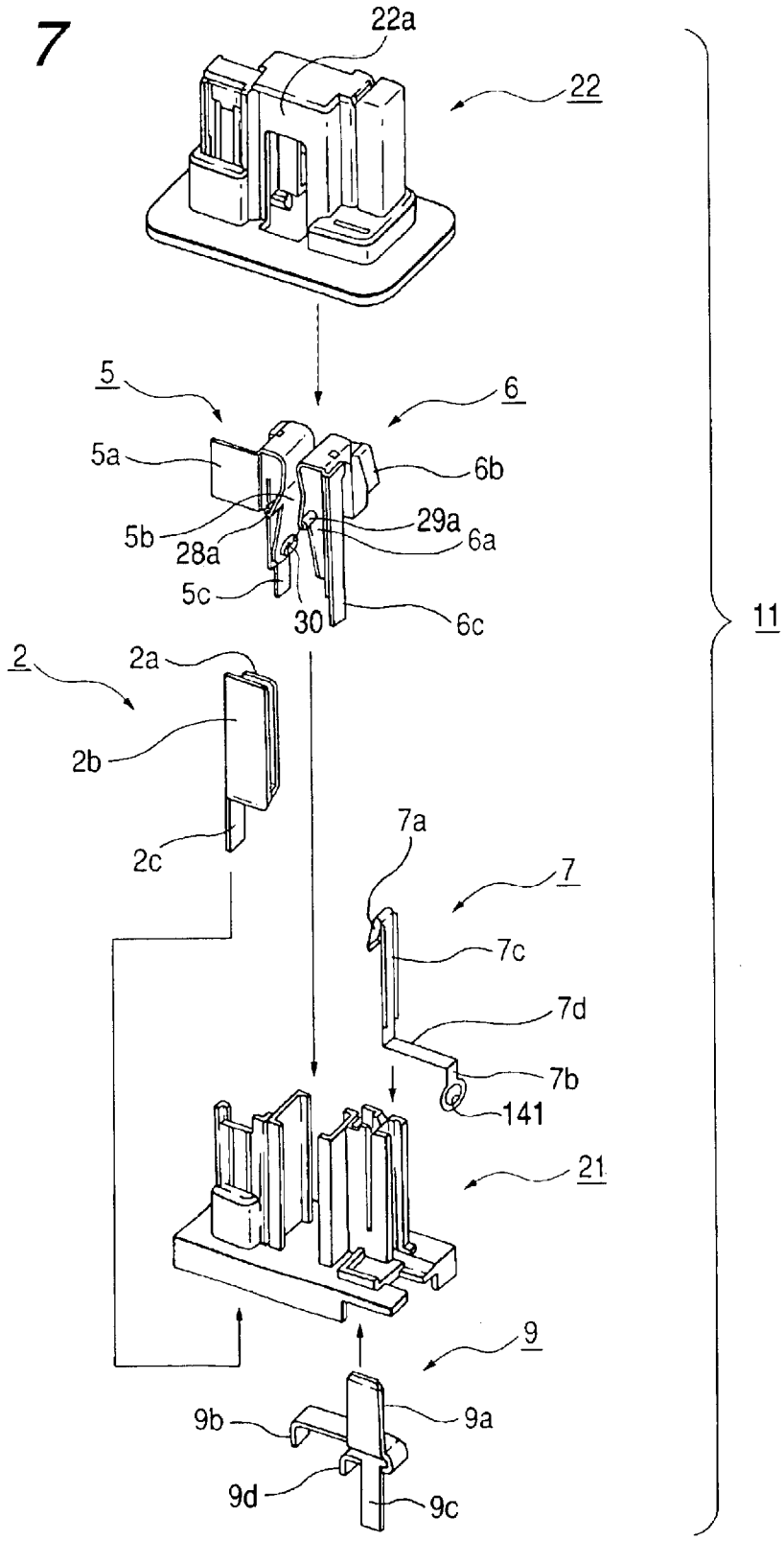
FIG. 7 is an exploded perspective view showing a stationary unit.
Figure 10:
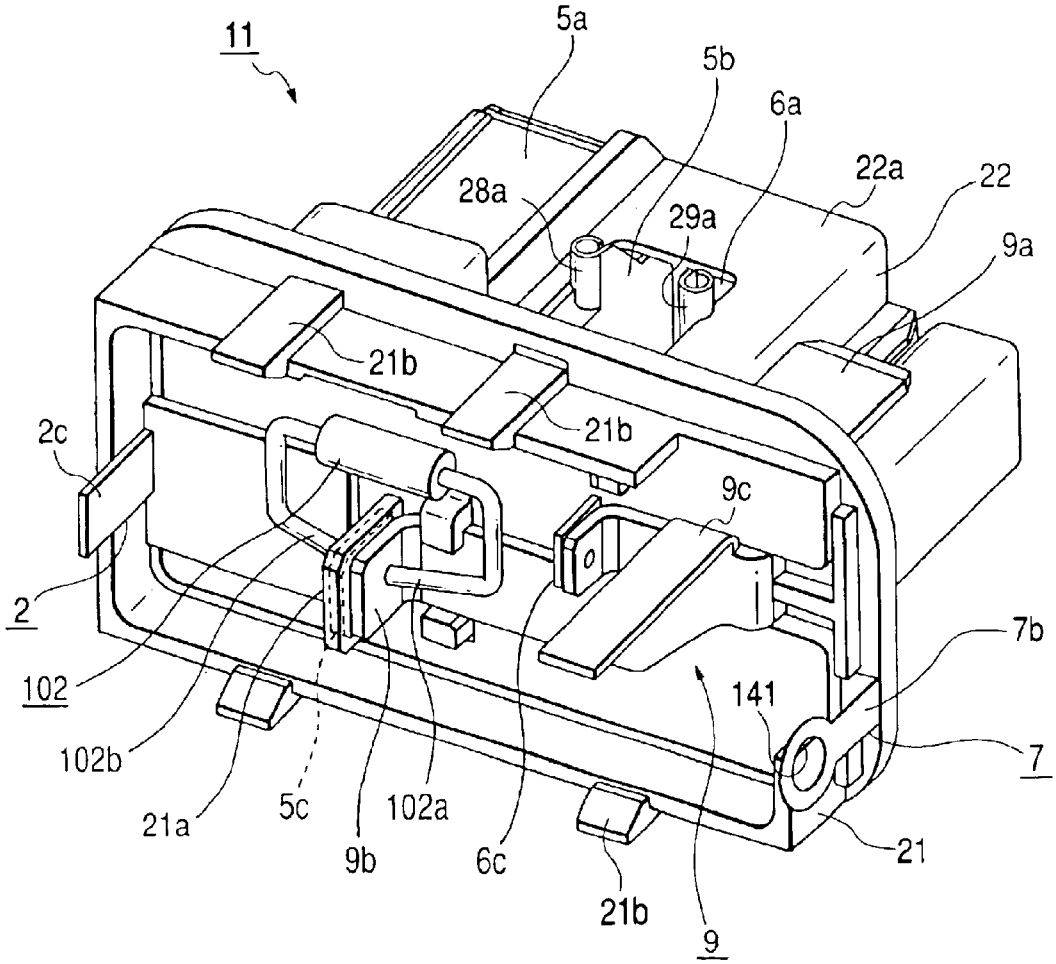
FIG. 10 is a view of the stationary unit taken from the lower side.

To the housing 21, as shown in FIG. 7, there is attached the output terminal 9 from the power side. This output terminal 9 is provided with terminal portions 9*a*, 9*b*, 9*c* and 9*d*. In FIGS. 7 and 8, the terminal portion 9*a* extends upward so that it is exposed to the outside of the housing cover 22. As shown in FIG. 7, the terminal portion 9*b* extends leftward, and the terminal portion 9*c* and the terminal portion 9*d* extend downward. As shown in FIG. 10, the terminal portion 9*b* is arranged on the right side of a tongue member 21*a* disposed on the lower side of the housing 21. The terminal portion 9*b* is connected to one end 102*a* of the capacitor 102. On the other hand, the terminal portion 9*c* is arranged on the right side of the tongue member 21*a*. The terminal portion 9*c* is projected into the connector mounting portion 93 through the output terminal inserting hole 120*a*. When the connector is mounted on the connector mounting portion 93 in this state, the terminal portion 9*c* is electrically connected with the electric load 101.

Figure 9:
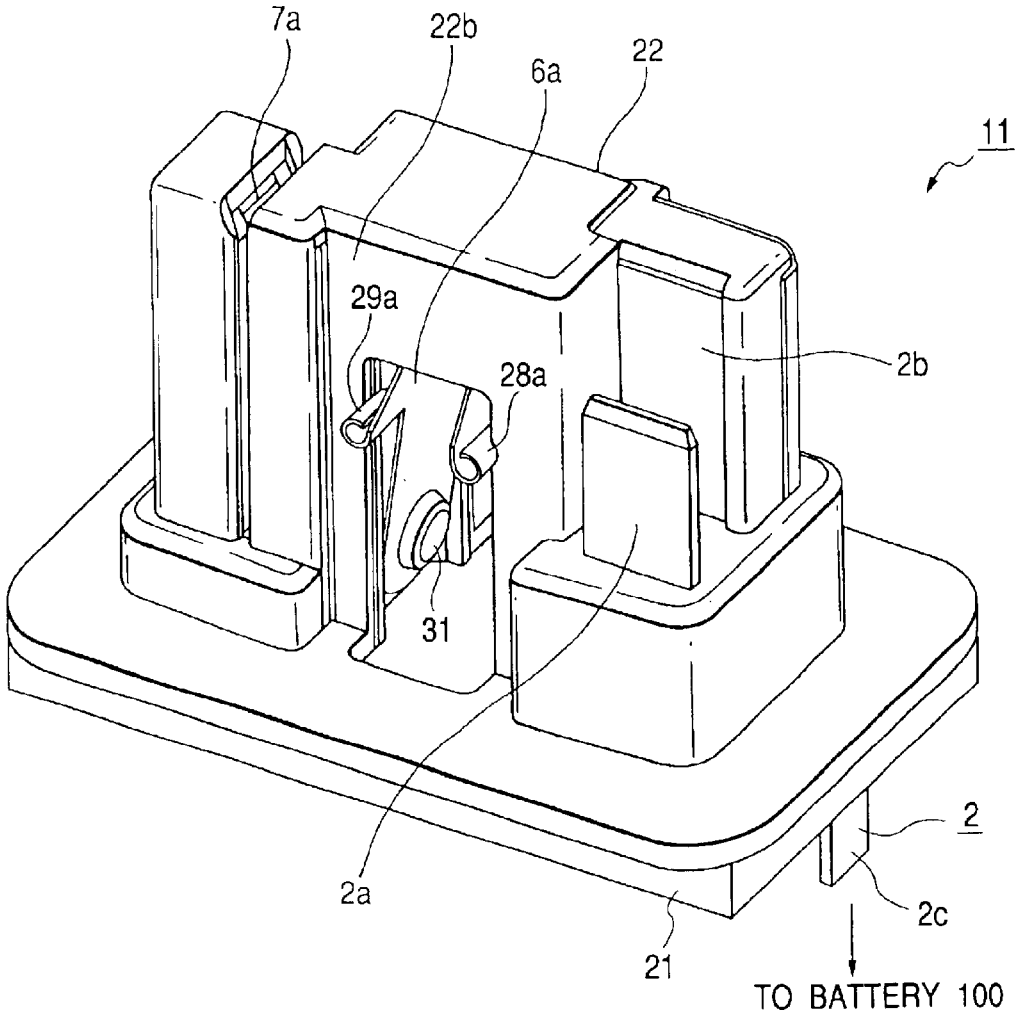
FIG. 9 is a perspective view of an essential portion of the stationary unit.
Figure 12:
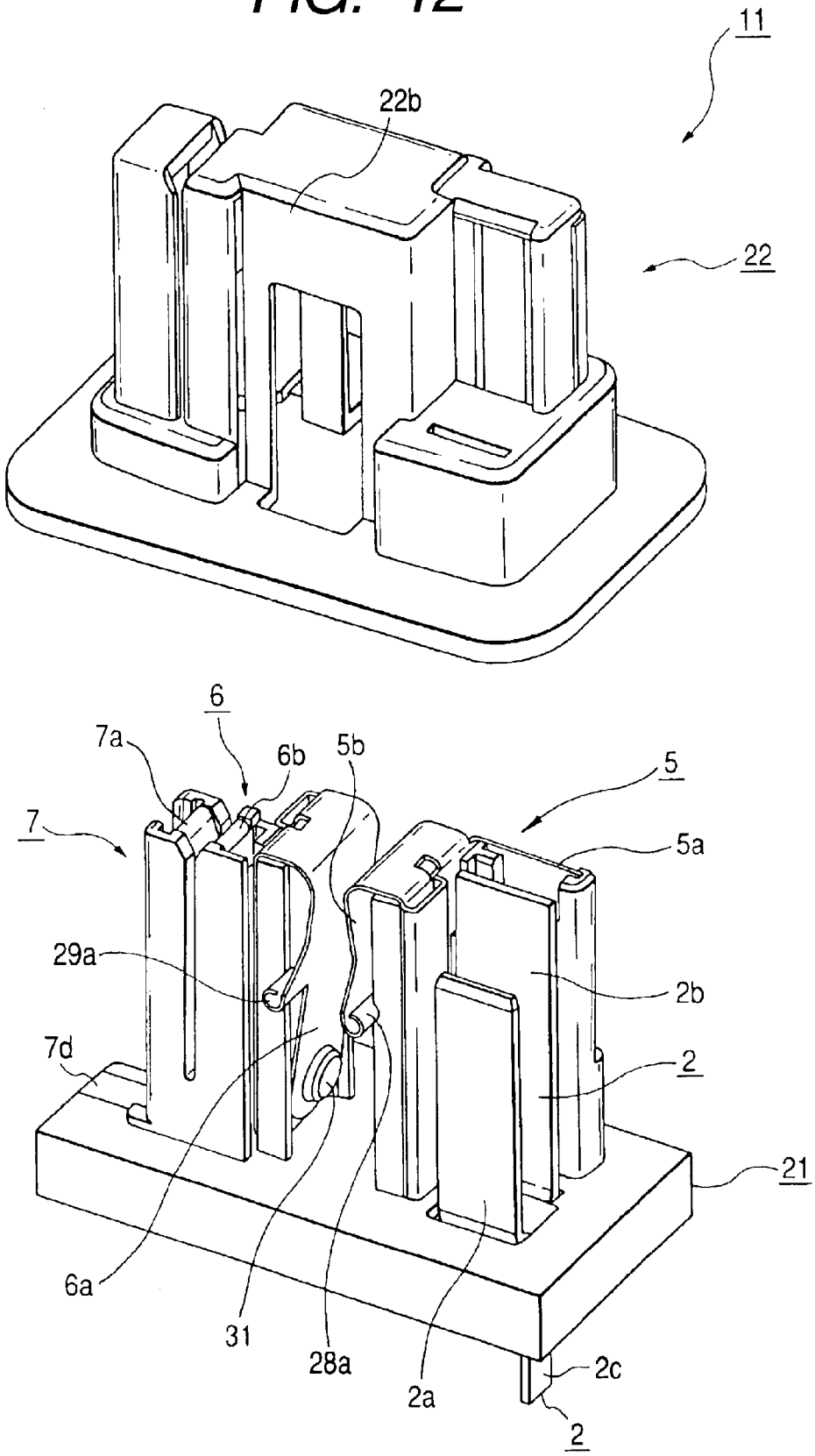
FIG. 12 is an exploded perspective view showing the stationary unit.

To the housing 21, as shown in FIG. 7, there is attached the terminal member 6 from the upper side. This terminal member 6 is provided with the terminal portions 6*b* and 6*c* and the spring member 6*a*. As shown in FIG. 10, the terminal portion 6*c* extends vertically through the housing 21. This terminal portion 6*c* makes contact with the terminal portion 9*d* on the lower side of the housing 21. To the lower end portion of the spring member 6*a*, as shown in FIGS. 9 and 12, there is attached the terminal protecting contact 31. Moreover, the spring member 6*a* is provided with the turning portion 29*a* at its longitudinally central portion. In the state where the housing cover 22 is attached to the housing 21, as shown in FIGS. 8 and 9, the two end portions of the turning portion 29*a* are projected from the side faces 22*a* and 22*b* of the housing cover 22.

Figure 11:
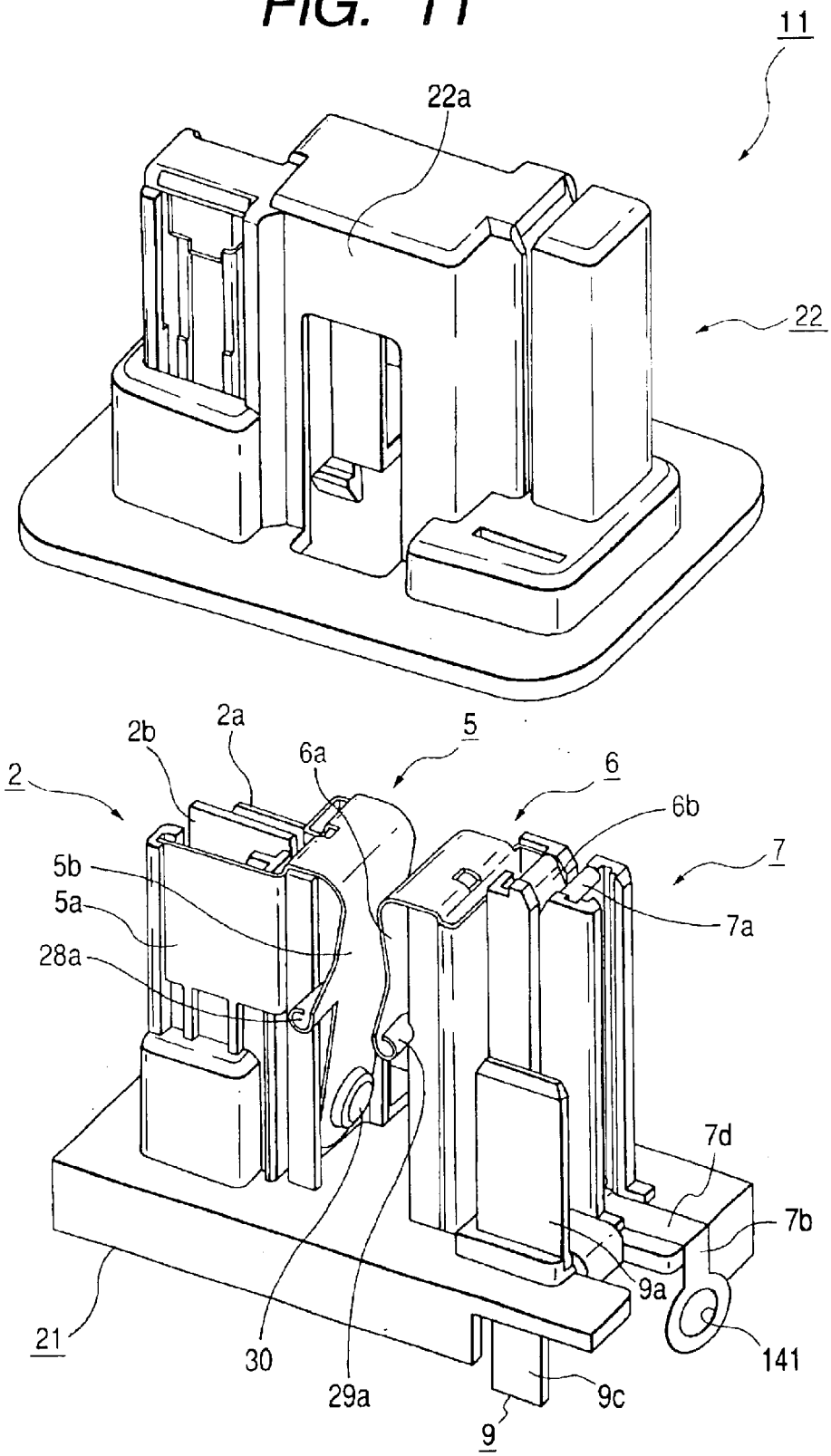
FIG. 11 is an exploded perspective view showing the stationary unit.

To the housing 21, as shown in FIG. 7, there is attached the terminal member 5 from the upper side. This terminal member 5 is provided with the power switching terminal portion 5*a*, a terminal portion 5*c* and the spring member 5*b*. As shown in FIGS. 7 and 8, the power switching terminal portion 5*a* is formed by bending it from the terminal portion 5*c* and is exposed to the outside of the housing cover 22. As shown in FIG. 10, the terminal portion 5*c* extends vertically through the housing 21. The terminal portion 5*c* is arranged on the left side of the terminal portion 21*a* disposed on the lower side of the housing 21. The terminal portion 5*c* is insulated by the terminal portion 21*a* from the terminal portion 9*b*. The terminal portion 5*c* is connected with the other end 102*b* of the capacitor 102. As shown in FIGS. 8 and 11, the spring member 5*b* confronts the spring member 6*a*. At the lower end portion of the spring member 5*b*, on the other hand, the terminal protecting contact 30 is arranged to abut against the terminal protecting contact 31. Moreover, the turning portion 28*a* is disposed at the central portion of the longitudinal direction of the spring member 5*b*. In the state where the housing cover 22 is attached to the housing 21, as shown in FIGS. 8 and 9, the two end portions of the turning portion 28*a* is projected from the side faces 22*a* and 22*b* of the housing cover 22.

To the housing 21, as shown in FIG. 7, there is attached the input terminal 2 from the lower side. This input terminal 2 is provided with the power switching terminal portion 2*b*, the terminal portion 2*a* and a terminal portion 2*c*. As shown in FIG. 9, too, the power switching terminal portion 2*b* extends upward so that it is exposed to the outside of the housing cover 22. The power switching terminal portion 2*b* is arranged on the opposite side of the power switching terminal portion 5*a* across the housing 21. Moreover, the terminal portion 2*a* extends upward so that it is exposed to the outside of the housing cover 22. The terminal portion 2*c* extends downward so that it is exposed to the outside of the housing cover 22. Here, this terminal portion 2*c* is inserted through the input terminal inserting hole 119*a* into the mounting portion 92 so that it is electrically connected with the conductor plate 124. Therefore, the terminal portion 2*c* is electrically connected with the positive terminal 106 of the battery 100.

To the housing 21, as shown in FIG. 7, there is attached the bus bar (or the conductor plate) 7 from the upper side. This bus bar 7 is formed by bending a metal sheet generally into an L-shape. This bus bar 7 is provided with a vertical member 7*c*, the terminal portion 7*a*, a horizontal member 7*d* and the tab portion 7*b*. The terminal portion 7*a* is folded back from the upper end of the vertical member 7*c*. As shown in FIGS. 11 and 12, the terminal portion 7*a* confronts the terminal portion 6*b*. The tab portion 7*b* is provided at one end of the horizontal member 7*d*. As shown in FIGS. 8, 10 and 11, the tab portion 7*b* projects downward from the housing 21. As shown in FIG. 4, this tab portion 7*b* is inserted through the bus bar inserting hole 116 and makes contact with the other end of the conductor plate 114. Moreover, the tab portion 7*b* is provided with a bolt inserting hole 141. In this state, the not-shown bolt is inserted into the bolt inserting hole 141 and is fastened into the other end of the conductor plate 114. Then, the bus bar 7 and the conductor plate 114 are fixed on each other. As a result, the bus bar 7 is electrically connected with the discharge resistor 103.

As shown in FIG. 1, the movable member 12 is removably attached to the stationary unit 11. As shown in FIGS. 5 and 6, too, the movable member 12 interrupts, when detached from the stationary unit 11 at the working time for maintenances, the power supply from the battery 100 to the electric load 101.

Figure 13:
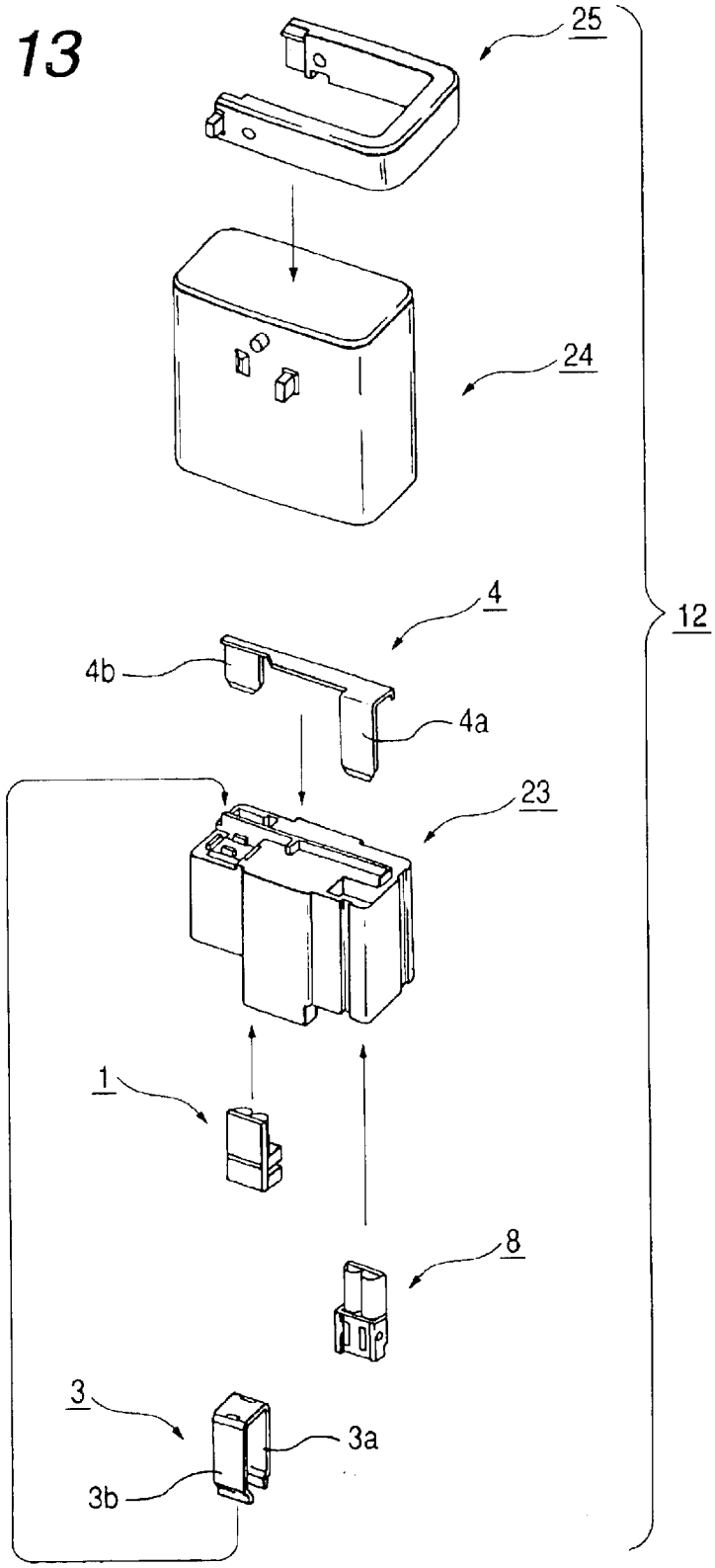
FIG. 13 is an exploded perspective view showing the movable member.

As shown in FIG. 13, the movable member 12 is constructed by housing a plug housing 23 in a plug housing cover 24. The plug housing 23 and the plug housing cover 24 are formed of an insulating material such as a synthetic resin.

Figure 15:
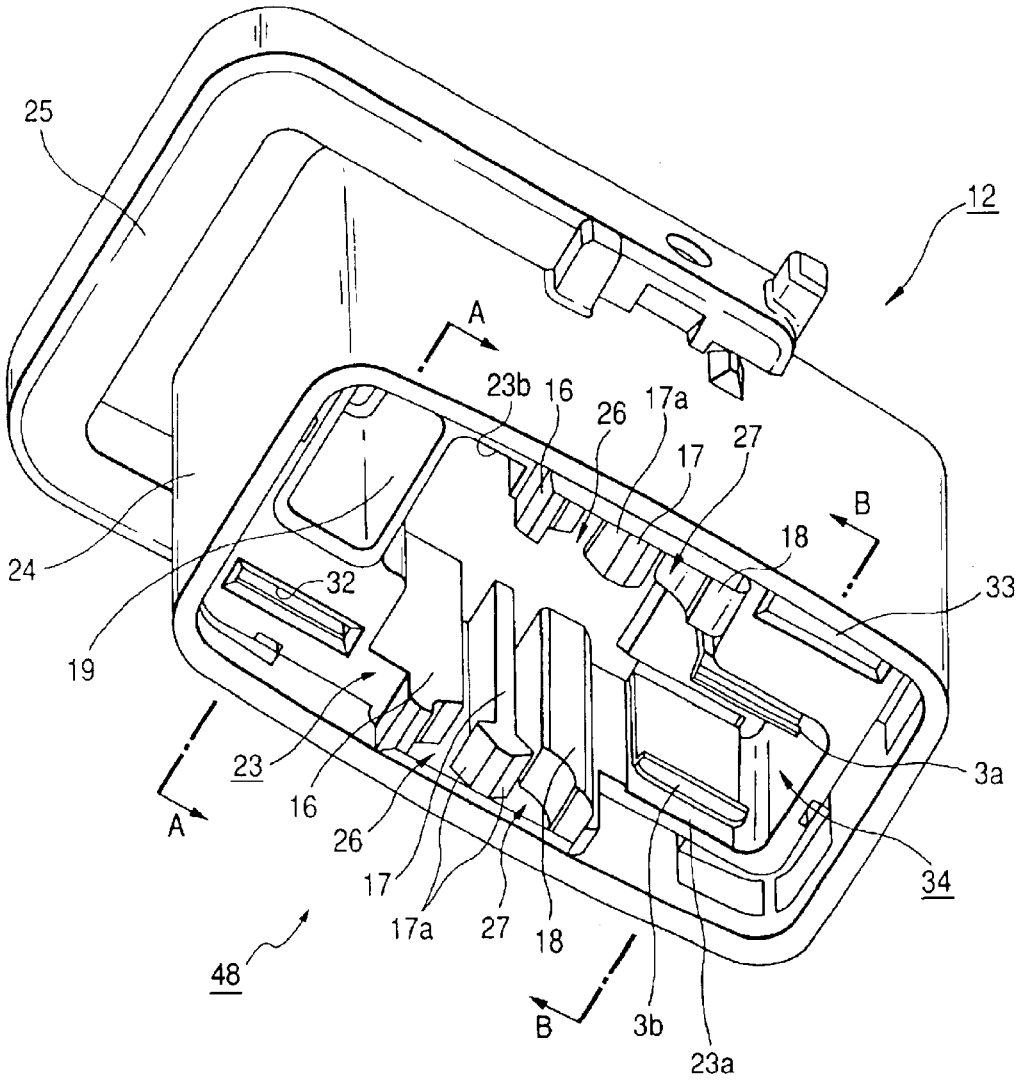
FIG. 15 is a perspective view of the entirety of the movable member.

On the inner side faces 23*a* an 23*b* of the plug housing 23, as shown in FIG. 15, there are formed the depending members 16, 17 and 18 which construct the control unit. Between the depending members 16 and 17, there is formed the guide groove 26. This guide groove 26 guides the turning portion 28*a*. Between the depending members 17 and 18, on the other hand, there is formed the guide groove 27. This guide groove 27 guides the turning portion 29*a*. On the left side of the depending member 16, on the other hand, there is formed the depending member 19 which insulates the terminal portions 6*b* and 7*a* in the attached state.

In the vicinity of the depending member 19, as shown in FIG. 15, there is formed an insertion hole 32. Into this insertion hole 32, there is inserted the terminal portion 9*a*. On the right side of the depending member 18, as shown in FIG. 15, there is formed an insertion hole 33. Into this insertion hole 33, there is inserted the terminal portion 2*a*.

Figure 17:
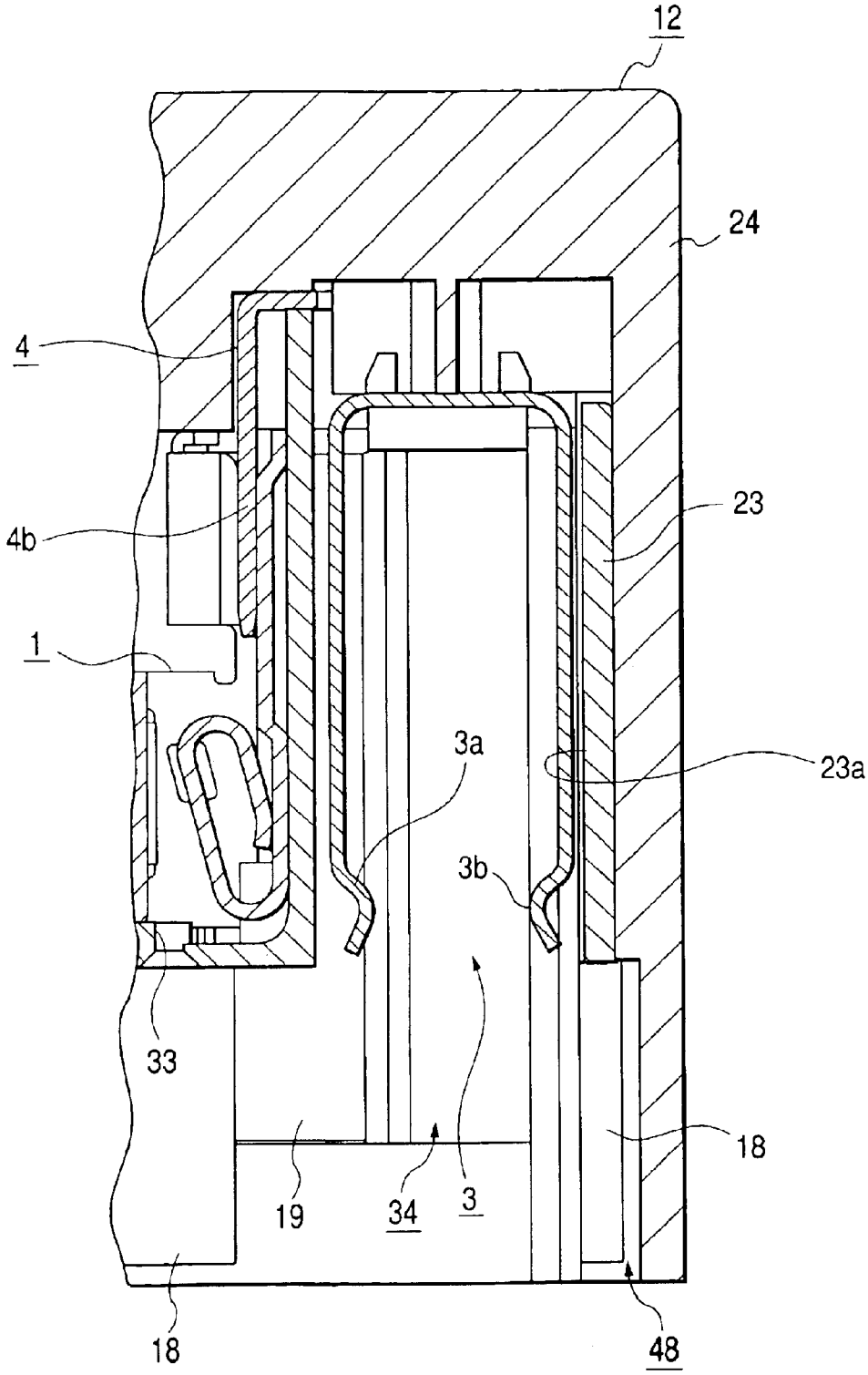
FIG. 17 is a schematic section taken along line B—B of FIG. 15.

To the plug housing 23, as shown in FIGS. 13 and 17, there is attached the connecting conductor 3 from the upper side. This connecting conductor 3 is formed generally into a C-shape and is provided with the terminal portions 3*a* and 3*b*. These individual terminal portions 3*a* and 3*b* are exposed into a cavity 34 formed in the vicinity of the insertion hole 33. The power switching terminal portion 2*b* is connected with the terminal portion 3*a*. On the other hand, the power switching terminal portion 5*a* is connected with the terminal portion 3*b*.

Figure 16:
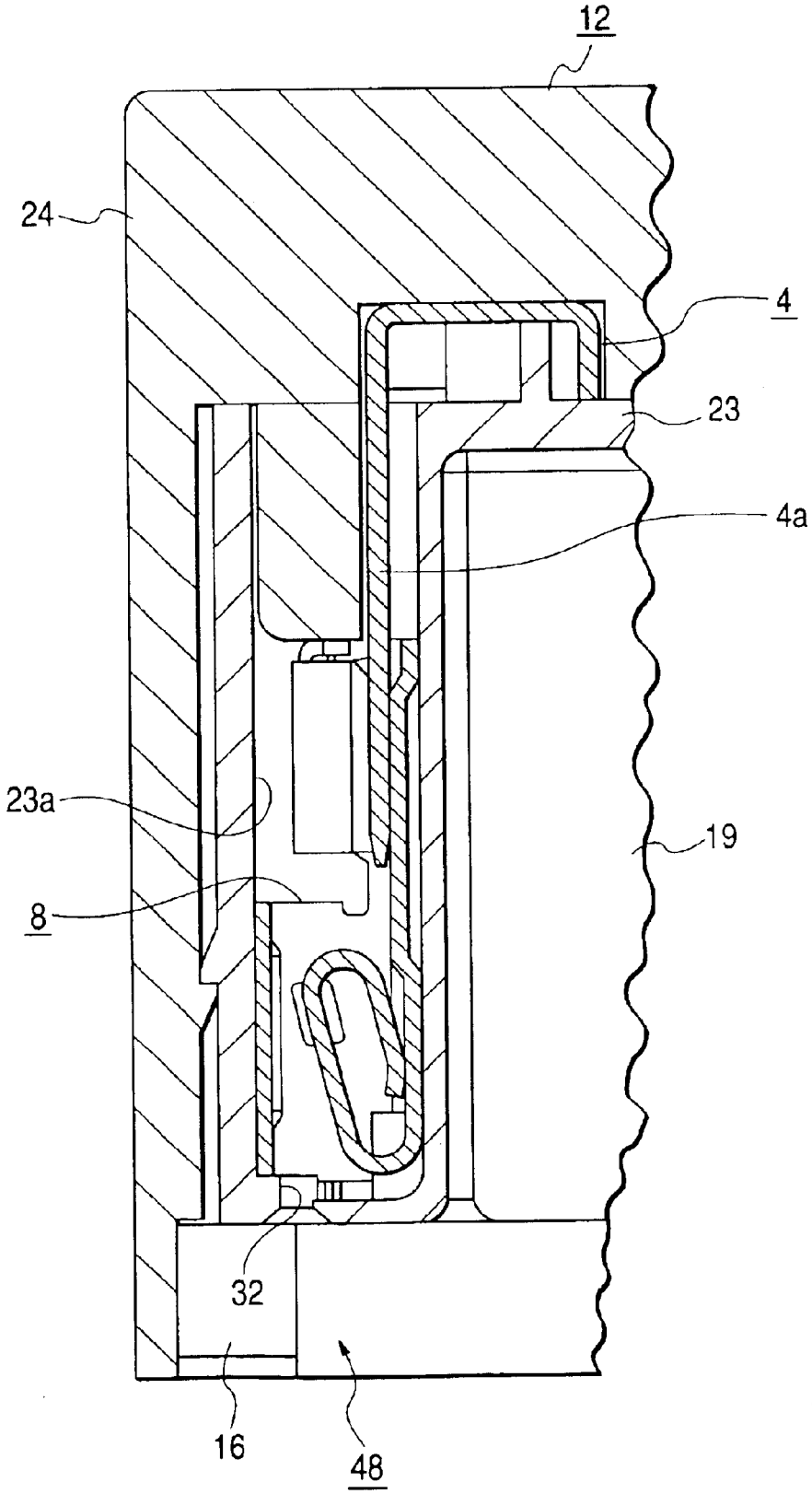
FIG. 16 is a schematic section taken along line A—A of FIG. 15.

On the upper side of the insertion hole 32, as shown in FIG. 16, there is arranged the moving side connecting terminal 8. On the upper side of the insertion hole 33, on the other hand, there is arranged the moving side connecting terminal 1, as shown in FIG. 17. To the plug housing 23, as shown in FIG. 13, there is attached the conductor member 4 from the upper side. On the two sides of the conductor member 4, there are formed downward terminal portions 4*a* and 4*b*, of which the terminal portion 4*a* is longer than the terminal portion 4*b*. As shown in FIG. 16, the terminal portion 4*a* is connected with the moving side connecting terminal 8. With this moving side connecting terminal 8, there is connected the terminal portion 9*a*. As shown in FIG. 17, the terminal portion 4*b* is connected with the moving side connecting terminal 1. With this moving side connecting terminal 1, there is connected the terminal portion 2*a*.

Figure 14:
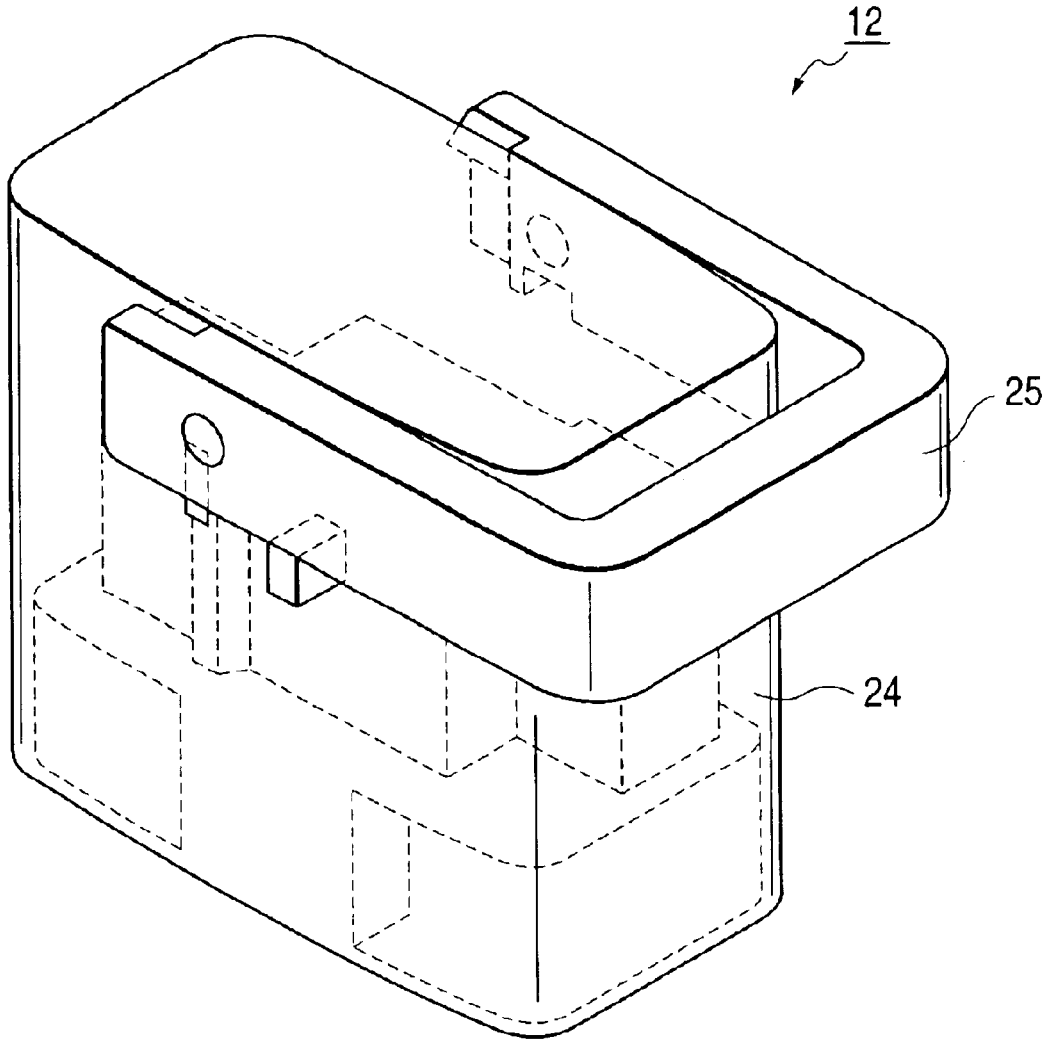
FIG. 14 is a perspective view of the entirety of the movable member.

To the outer sides of the plug housing cover 24, as shown in FIGS. 13 to 15, there is turnably attached the lever 25. This lever 25 is formed generally into a C-shape and is formed of an insulating material such as a synthetic resin. As shown in FIGS. 2 and 3, the lever 25 is turned in the opposite direction away from the side, on which the fuse mounting portions 113*a* and 113*b* and the current sensor mounting portion 113*c* are mounted in the attached state. This lever 25 is retained on the hook portion 41*a*.

Here will be described the method for detaching the movable member 12 from the stationary unit 11 before the electric load 101 is maintained.

First of all, the upper cover 118 is detached from the electric connection box 111 shown in FIG. 1, to expose the upper face of the box body 113. In the state shown in FIGS. 2, 3 and 6, the lever 25 is then pulled upward.

As a result, the movable member 12 is detached from the stationary unit 11.

The step of detaching the movable member 12 from the stationary unit 11 will be described by dividing it into first to fifth steps.

At the first step, the power switching terminal portion 5*a* and the terminal portion 3*b* are connected from the state shown in FIG. 6. At this time, the power switching terminal portion 2*b* and the terminal portion 3*a* keep their connected state. On the other hand, the terminal portions 6*b* and 7*a* are insulated by the depending member 19, but the terminal protecting contacts 30 and 31 make contact with each other. Moreover, the terminal portion 9*a* is connected with the moving side connecting terminal 8, and the terminal portion 2*a* is connected with the moving side connecting terminal 1. Therefore, the voltage of the battery 100 is applied to the electric load 101 via both the first current path and the second current path.

At the second step, the moving side connecting terminal 8 and the terminal portion 9*a* are disconnected from each other, and the moving side connecting terminal 1 and the terminal portion 2*a* are disconnected from each other. At this time, the terminal portions 6*b* and 7*a* are insulated by the depending member 19, but the terminal protecting contacts 30 and 31 make contact with each other. Moreover, the terminal portion 3*a* and the power switching terminal portion 2*b* are connected with each other, and the terminal portion 3*b* and the power switching terminal portion 5*a* are connected with each other. Therefore, the first current path comes into the OFF state, but the second current path 15 keeps the ON state. Therefore, the voltage of the battery 100 is continuously applied to the electric load 101 via the second current path 15. At this point of time, an arc is suppressed between the terminal portions 2*a* and 9*a* and the moving side connecting terminals 1 and 8 so that these moving side connecting terminals 1 and 8, the input terminal 2 and the output terminal 9 are effectively protected.

At the third step, the turning portions 28*a* and 29*a* are guided by the thick portion 17*a* so that the spring members 6*a* and 5*a* leave each other to separate the terminal protecting contacts 30 and 31 from each other. At this time, the terminal portions 6*a* and 7*a* are insulated by the depending member 19. Moreover, the terminal portion 3*a* and the power switching terminal portion 2*b* are connected with each other, and the terminal portion 3*b* and the power switching terminal portion 5*a* are connected with each other. If the electric power is high at this point of time, an arc discharge is made between the terminal protecting contact 30 and the terminal protecting contact 31 by the voltage from the battery 100. Therefore, the arc is discharged only between the two terminal protecting contacts 30 and 31 but not between the input and output terminals 2 and 9 and the moving side connecting terminals 1 and 8. Therefore, these moving side connecting terminals 1 and 8, the input terminal 2 and the output terminal 9 are protected without fail. Thus, the protecting function unit constructed of the stationary unit 11 and the movable member 12 can match the high voltage of the battery 100.

At the fourth step, the terminal portion 3*b* comes out of the upper end of the power switching terminal portion 5*a*, and the terminal portion 3*a* comes out of the upper end of the power switching terminal portion 2*b*. At this time, the terminal portions 6*b* and 7*a* are insulated by the depending member 19.

At the fifth step, moreover, the terminal portions 6*b* and 7*a* abut against each other so that the voltage stored in the capacitor 121 is discharged through the discharge resistor 103.

As a result, the power supply from the battery 100 to each electric load 101 is interrupted, as shown in FIG. 5. This makes it possible to maintain the electric load 101.

Therefore, the following effects can be obtained according to the present embodiment.

(1) The stationary unit 11 constructing the protecting function unit together with the movable member 12 is formed integrally with the box body 113 so that an attaching structure for fixing the protecting function unit in the box body 113 need not be manufactured separately of the electric connection box 111. Therefore, the number of parts constructing the protecting function unit is made smaller to make the construction of the protecting function unit simpler than those of the case in which the stationary unit 11 is manufactured separately of the box body 113. Therefore, it is possible to lower the cost necessary for mounting the construction corresponding to the protecting device on the electric connection box 111, as in the prior art. Moreover, the space for arranging the attaching structure in the box body 113 can be eliminated to reduce the size of the electric connection box 111.

Moreover, the electric connection box 111 is provided with the protecting function unit constructed of the stationary unit 11 and the movable member 12. Even if the space for mounting the protecting device of the prior art cannot be retained in the engine room, therefore, the electric connection box 111 can be reliably given the protecting function. Moreover, the stationary unit 11 is integrated with the box body 113 so that the construction for connecting the stationary unit 11 and the box body 113 electrically need not be provided. Therefore, it is possible to improve the reliability of the electric connection box 111.

(2) The stationary unit 11 is arranged on the upper side of the box body 113. When the upper cover 118 is detached from the box body 113 so as to maintain the electric load 101, therefore, the movable member 12 is exposed to an easily visible position. Therefore, it is possible to improve the controllability of the movable member 12.

Moreover, the movable member 12 is mounted and housed in the mounting recess 112. Therefore, the projection of the movable member 12 from the box body 113 is shorter than that of the case in which the movable member 12 is placed on the upper face of the box body 113, for example. Therefore, it is possible to set the height of the upper cover 118 smaller. Therefore, it is possible to reduce the size of the electric connection box 111 as a whole.

At this time, the movable member 12 is held not only on its bottom face but also its side faces by the mounting recess 112. Therefore, it is possible to improve the attaching strength of the movable member 12. Moreover, the probability for an external force to act directly on the movable member 12 is lowered, and the movable member 12 is prevented from coming out of position even if the external force acts on the movable member 12. Therefore, the electric connection between the movable member 12 and the electric connection box 111 can be reliably kept to stabilize the power supply from the battery 100 to the electric load 101.

Moreover, the exposed portion is reduced in the movable member 12. Even if water invades into the electric connection box 111, therefore, the movable member 12 is less probably wetted with the water. Therefore, it is possible to improve the water-proofness of the movable member 12.

(3) The stationary unit 11 and the movable member 12 constructing the protecting function unit are housed in the electric connection box 111 while being covered with the upper cover 118. Therefore, it is possible to protect the stationary unit 11 and the movable member 12 against water.

(4) The movable member 12 is provided with the lever 25 so that it can be easily attached and detached. Moreover, the lever 25 is tilted in the opposite direction away from the side of the fuse mounting portions 113*a* and 113*b* and the current sensor mounting portion 113*c* so that it can be prevented from obstructing the maintaining works of the fuses 71 and 72 and the current sensor. When the lever 25 is gripped, moreover, the hands of the worker can be kept away from touching the fuses 71 and 72, the current sensor and so on.

(5) The mounting recess 112 is opened in the box body 113 in the face which is provided with the fuse mounting portions 113*a* and 113*b* and the current sensor mounting portion 113*c*. If the upper cover 118 is detached from the box body 113 at the time of maintaining the electric load 101, therefore, the fuse mounting faces 113*a* and 113*b*, the current sensor mounting unit 113*c* and the movable member 12 are exposed to the common face. Therefore, the work of detaching the movable member 12 and the works of maintaining the fuses 71 and 72 and the current sensor can be done in the common face. Therefore, it is possible to improve the maintainability of the electric connection box 111.

(6) The stationary unit 11 is provided with the retaining portion 41 for retaining the lever 25. When this lever 25 is not used, therefore, it can be retained by the retaining portion 41. Therefore, it is possible to prevent the lever 25 from chattering due to vibrations or the like coming from the outside. Thus, it is possible to prevent noises from the electric connection box 111.

(7) The terminal protecting contacts 30 and 31 are made of a material having a higher arc-resistances than that of the input terminal 2 and the output terminal 9. Therefore, the terminal protecting contacts 30 and 31 can be used for a long time, and the number of their maintenances can be reduced. Here, the highly arc-resisting material has a higher resistance than that of the ordinary conductive material (e.g., copper). With the movable member 12 being mounted on the stationary unit 11, however, the second current path 15 is turned OFF by the power switching means 13 so that the power is supplied to each electric load 101 via the first current path. Therefore, no trouble occurs even if the two terminal protecting contacts 30 and 31 have high resistances.

(8) The capacitor 102, is connected in parallel with the terminal protecting contacts 30 and 31 so that the arc discharge between the terminal protecting contacts 30 and 31 is suppressed by the storing action of the capacitor 102. Therefore, it is possible to elongate the lifetimes of the terminal protecting contacts 30 and 31. In this case, too, the second current path 15 including the capacitor 102 is turned OFF at the time of the power supply to each electric load 101 so that no trouble is involved in the power supply.

(9) The terminal protecting contacts 30 and 31 are provided with the elastically deformable spring members 5*b* and 6*a*, respectively, so that they may come into and out of contact. These spring members 5*b* and 6*a* are spaced from each other when the movable member 12 is not mounted on the stationary unit 11. Moreover, the individual spring members 5*b* and 6*a* are forced to contact by the control unit 48 when the movable member 12 is mounted on the stationary unit 11. Even if the electric circuit such as an electromagnetic relay is not used, therefore, the terminal protecting contacts 30 and 31 can be turned ON/OFF. Thus, it is possible to simplify the structure for bring the terminal protecting contacts 30 and 31 into and out of contact.

Here, the embodiment of the invention may be modified in the following manners.

In the embodiment, the stationary unit 11 is arranged on the upper side of the electric connection box 111. However, the stationary unit 11 may be arranged on the side face or the bottom face of the electric connection box 111.

In the embodiment, the stationary unit 11 may be provided with, in place of the mounting recess 112, a mounting face, to which the movable member 12 is attached.

In the embodiment, that face of the box body 113, in which the mounting recess 112 is formed, is covered with the upper cover 118. However, that face having the mounting recess 112 of the box body 113 may be exposed to the outside.

In the embodiment, the lever is tilted in the opposite direction away from the side of the fuse mounting portions 113*a* and 113*b* and the current sensor mounting portion 113*c*. However, the lever 25 may be tilted either in the direction to the side of the fuse mounting portions 113*a* and 113*b* and the current sensor mounting portion 113*c* or in another direction. Moreover, the lever 25 may be omitted.

In the embodiment, the stationary unit 11 is provided with the retaining portion 41 for retaining the lever 25. However, this retaining portion 41 may be omitted. Moreover, the retaining portion 41 is omitted, and the wall portion 21*b* of the stationary unit 11 may contact with the lever 25 there by to fix the lever 25 by a frictional force to be generated between the wall portion 21*b* and the lever 25.

In the embodiment, the input terminal 2, the connecting conductor 3, the conductor member 4, the terminal members 5 and 6, the bus bar 7 and the output terminal 9 are constructed of a plurality of terminal portions, but the invention should not be limited to the construction. For example, the individual terminal portions may be formed separately of one another and may be connected to each other by welding them or through electric wires to form the input terminal 2, the connecting conductor 3, the conductor member 4, the terminal members 5 and 6, the bus bar 7 and the output terminal 9. Of these, the terminal members 5 and 6 may be formed of an elastic material exclusively at their spring members 5*b* and 6*a*, and these spring members 5*b* and 6*a* may be connected to the remaining portions. Here, the elastic material should not be limited to the phosphor bronze.

In the embodiment, the power switching means 13 is provided on the side of the battery 100 whereas the first contact means 14 is disposed on the side of the electric load 101. However, the power switching means 13 is provided on the side of the electric load 101 whereas the first contact means 14 is disposed on the side of the battery 100.

Here will be enumerated the technical concepts which are grasped by the embodiment and other examples.

(1) An electric connection box having a protecting function of any of Aspects 2 to 4, wherein the mounting recess is opened in that face of the box body which is provided with the electric part mounting portion. According to the technical concept (1), therefore, it is possible to improve the maintainability of the electric connection box.

(2) An electric connection box having a protecting function of Aspect 4, wherein the stationary unit is provided with a retaining portion for retaining the lever. According to the technical concept (2), therefore, it is possible to prevent the chattering of the lever.

(3) An electric connection box having a protecting function of either of Aspect 4 or the technical concept (2), wherein the electronic part is a fuse and a current sensor.

(4) An electric connection box having a protecting function of any of Aspects 1 to 4 and the technical concepts (1) to (3), wherein the stationary unit includes: an input terminal connected with the vehicle-mounted power source; an output terminal connected with the electric load; and a projection housing the input terminal and the output terminal, and wherein the movable member includes: a moving side connecting terminal to be connected with the input terminal and the output terminal when the stationary unit is mounted; and a cover portion for covering the protrusion when the stationary unit is mounted.

(5) An electric connection box having a protecting function of any of Aspects 1 to 4 and the technical concepts (1) to (4), further comprising: a first current path including the input terminal disposed in the stationary unit and connected with the vehicle-mounted power source, the output terminal disposed in the stationary unit and connected with the electric load, and the moving side connecting terminal disposed in the movable member and connected with the input terminal and the output terminal when the movable member is mounted on the stationary unit; and a second current path disposed in the stationary unit for connecting the input terminal and the output terminal independently of the first current path, wherein the second current path includes: power switching means for turning OFF the second current path when the movable member is mounted on the stationary unit and for turning ON the second current path when the movable member is to be detached from the stationary unit and before the input terminal, the output terminal and the individual moving side connecting terminals leave; and a pair of terminal protecting contacts for making contact with each other when the movable member is mounted on the stationary unit and for leaving each other when the movable member is to be detached from the stationary unit and after the second current path was switched from OFF to ON by the power switching means.

(6) An electric connection box having a protecting function of the technical concept (5), wherein the two terminal protecting contacts are made of a material having a higher arc-resistance than that of the input terminal and the output terminal.

(7) An electric connection box having a protecting function of either the technical concept (5) or (6), further comprising a capacitor in parallel with the two terminal protecting contacts.

(8) An electric connection box having a protecting function of any the technical concepts (5) to (7), wherein the two terminal protecting contacts have elastically deformable spring members individually so that they leave each other, when they receive no external force, but are forced to make contact with each other by a control unit disposed in the movable member, when the movable member is mounted on the stationary unit.

(9) An electric connection box having a protecting function of any the technical concepts (5) to (8), wherein the power switching means includes: power switching terminals disposed in the second current path while leaving each other; a connecting conductor disposed in the movable member so that it leaves at least one of the power switching terminals, when the movable member is mounted on the stationary unit, but makes contact with the power switching terminals to connect the same electrically when at least the two terminal protecting contacts leave the mutually contacting state.

(10) An electric connection box having a protecting function comprising: a stationary unit formed integrally with a box body; a movable member attached removably to the stationary unit for turning OFF the power supply from a vehicle-mounted power source to an electric load when it is detached from the stationary unit; a fuse mounting portion arranged between the vehicle-mounted power source and the stationary unit for preventing an overcurrent from flowing to the stationary unit; and a current sensor mounting portion arranged between the stationary unit and the vehicle-mounted power source and having a current sensor mounted thereon for detecting an electric current outputted from the stationary unit.

According to the invention of Aspect 1, as is described in detail, it is possible to lower the cost necessary for mounting the construction corresponding to the protecting device on the electric connection box. Even if the space for mounting the protecting device cannot be retained in the engine room, on the other hand, the electric connection box can be reliably given the protecting function. Moreover, it is possible to improve the reliability of the electric connection box.

According to the invention of Aspect 2, it is possible to improve the controllability of the movable member. Moreover, the electric connection box can be small-sized. Moreover, it is possible to stabilize the power supply from the vehicle-mounted power source to the electric load.

According to the invention of Aspect 3, the protecting function unit can be reliably protected against water. According to the invention of Aspect 4, the movable member can be easily attached/detached. Moreover, the lever can be prevented from obstructing the working time of maintaining the electric parts. When the lever is gripped, still moreover, the hands can be prevented from touching the electric parts or the like.

What is claimed is:

1. An electric connection box having a protecting function, comprising:

a box body;

a protecting function unit including a stationary unit formed integrally with said box body, wherein said stationary unit has at least an output terminal, an input terminal and a pair of terminal protecting contacts; and a movable member attached removably to said stationary unit, said movable member has an input connecting terminal and an output connecting terminal, said movable member being removably attached to said stationary unit in a first attached position in which said input connecting terminal contacts said input terminal and said output connecting terminal contacts said output terminal to form a first electrical path and said pair of terminal protecting contacts contact with one another in a first contact position, the movable member having bottom and side faces wherein a supply of an electric power from a vehicle-mounted power source to an electric load is interrupted by removing said movable member from said stationary unit, and wherein said stationary unit is a mounting recess arranged on an upper side of said box body for housing said movable member so that the movable member is held on its bottom and side faces by said mounting recess.

2. The electric connection box having a protecting function unit according to claim 1, wherein said movable member has a connecting conductor and said stationary unit has a power switching terminal portion, and when said power connecting conductor contacts said power switching terminal portion they together form a power switching device defining a second electrical current path.

3. The electric connection box having a protecting function according to claim 1, wherein a face of said box body, in which said mounting recess is formed, is covered with an upper cover.

4. The electric connection box having a protecting function according to claim 1, wherein said movable member comprises:

a lever which is capable to be tilted in an opposite direction away from the side of an electric part mounting portion capable of mounting an electric part.

5. The electric connection box having a protecting function according to claim 1, wherein said mounting recess has walls projecting upward from said upper side of said box body.

6. The electric connection box having a protecting function according to claim 2, wherein said power switching device turns off and on power to at least one of said first and second electrical paths.

7. The electric connection box having a protecting function according to claim 1, wherein said pair of terminal protecting contacts are movable between said first contact state and a second non-contact state.

8. The electric connection box having a protecting function according to claim 7, wherein when said movable member is in said first attached position, said movable member biases said pair of terminal protecting contacts so as to result in said first contact state.

9. The electric connection box having a protection function according to claim 1, wherein said movable member comprises:

a lever which is capable of being tilted in an opposite direction away from the side of an electric part mounting portion capable of mounting an electric part.

10. The electric connection box having a protecting function according to claim 7, wherein said movable member is movable to a second detached position separate from said stationary unit, and when in said second detached position said pair of terminal protecting contacts return to said second non-contact state.

11. The electric connection box having a protecting function according to claim 1, wherein said stationary unit further includes a pair of discharge terminals.

12. The electric connection box having a protecting function according to claim 11, wherein said movable member is movable to a second detached position separated from said stationary unit and said pair of discharge terminals form a second contact position when in said second detached position to discharge any stored power.

* * * * *